United States Patent [19]

Giordano et al.

[11] 4,291,807

[45] Sep. 29, 1981

[54] FOLDING BOX

[75] Inventors: Vincent Giordano, Wantagh, N.Y.; Charles Senor, Fairview, N.J.

[73] Assignee: International Folding Paper Box Co., Inc., Ridgefield, N.J.

[21] Appl. No.: 92,186

[22] Filed: Nov. 7, 1979

[51] Int. Cl.[3] ..... B65D 5/18; B65D 5/54

[52] U.S. Cl. ..... 206/626; 206/470; 206/806; 206/631; 229/37 R

[58] Field of Search ..... 206/806, 621, 461, 470, 206/631, 626; 229/37 R, 16 D

[56] References Cited

U.S. PATENT DOCUMENTS

| | | | |
|---|---|---|---|
| 2,210,872 | 8/1940 | Ariail | 229/37 R |
| 3,173,599 | 3/1965 | Silver | 206/626 X |
| 3,237,836 | 3/1966 | Nowak et al. | 229/37 R |
| 3,985,232 | 10/1976 | Johnson | 206/806 |
| 4,106,615 | 8/1978 | Hiroshi | 206/806 X |
| 4,146,128 | 3/1979 | Hogg et al. | 206/470 |

FOREIGN PATENT DOCUMENTS

| | | | |
|---|---|---|---|
| 2017644 | 10/1979 | United Kingdom | 206/806 |

*Primary Examiner*—Stephen P. Garbe

*Attorney, Agent, or Firm*—Ostrolenk, Faber, Gerb & Soffen

[57] ABSTRACT

A pilfer proof folding carton having a back wall with an extension forming a display panel and a front wall having a cover hingedly attached. The cover has a tuck-in flap which engages the back wall. A tear line in the back wall permits the panel to be removed. The tuck-in flap has a portion engaging the back wall between the tear line and the panel to which it is releasably secured and another portion extending below the tear line so that it may act as a tuck-in flap after removal of the panel.

6 Claims, 11 Drawing Figures

FOLDING BOX

BACKGROUND OF THE INVENTION

The present invention relates to folding boxes or cartons particularly to a tubular folding carton which may be delivered to the customer in collapsed tubular form and which is then erected to a four-sided or rectangular cross-section tube by the customer, filled with the merchandise provided by the customer and then sealed at the ends.

In particular the present invention relates to a box or carton of the character described which has a fifth panel which enables it to be held on a peg board or other support which panel, in addition, provides space for additional copy. Further the folding box or carton of the present invention is so designed and constructed that the fifth panel may be torn off and there will still remain a tuck-in flap which may be used to close the box.

In modern merchandising methods, merchandise to be distributed at the point of sale is usually presented to the prospective customer in a manner which will enable him to obtain it readily and take it to a check-out counter or cashier. Hence the need arises for the utilization of a carton with a display panel which will provide such copy or illustrations as will draw attention to a particular product and help distinguish it from other products which are competing for the eye of the customer. However, the utilization of the additional panel heretofore has resulted in a box which, when the panel was torn off so that the box could fit readily into the pocket of the consumer there is no means for reclosing the box.

One of the principal objects of the present invention is the provision of a carton the ends of which may be sealed by the manufacturer of the product. The carton is tubular in form with a tuck-in flap to close it. The hanging panel extends from the wall which is engaged by the tuck-in flap, a portion of the tuck-in flap lying against the wall from which the hanging panel extends, is secured by a series of glue dots or other readily rupturable sealing means to the said wall so that the box is sealed while it is hanging for display.

The wall from which the flap extends is also provided with a tear line just below the point of adhesive securement of the flap to the wall but above the lower end of the flap when it is tucked in. When the fifth panel is torn off along the tear line, the glue dots or other disconnectable connection to the tuck-in flap is also removed and the panel may be taken off and thrown away. However, because the tuck-in flap of the cover member extends down below the tear line, the carton may be readily opened to obtain a portion of the merchandise therein and readily closed and tucked in to provide a receptacle which may be carried about or stored with the assurance that the contents will not spill out.

The foregoing and other objects of the present invention will become apparent in the following description and drawings in which.

Figure 1:
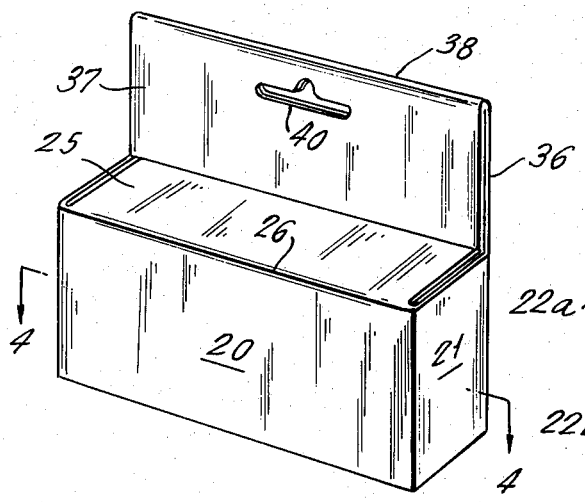
FIG. 1 is a front view in perspective of the carton of the present invention.
Figure 2:
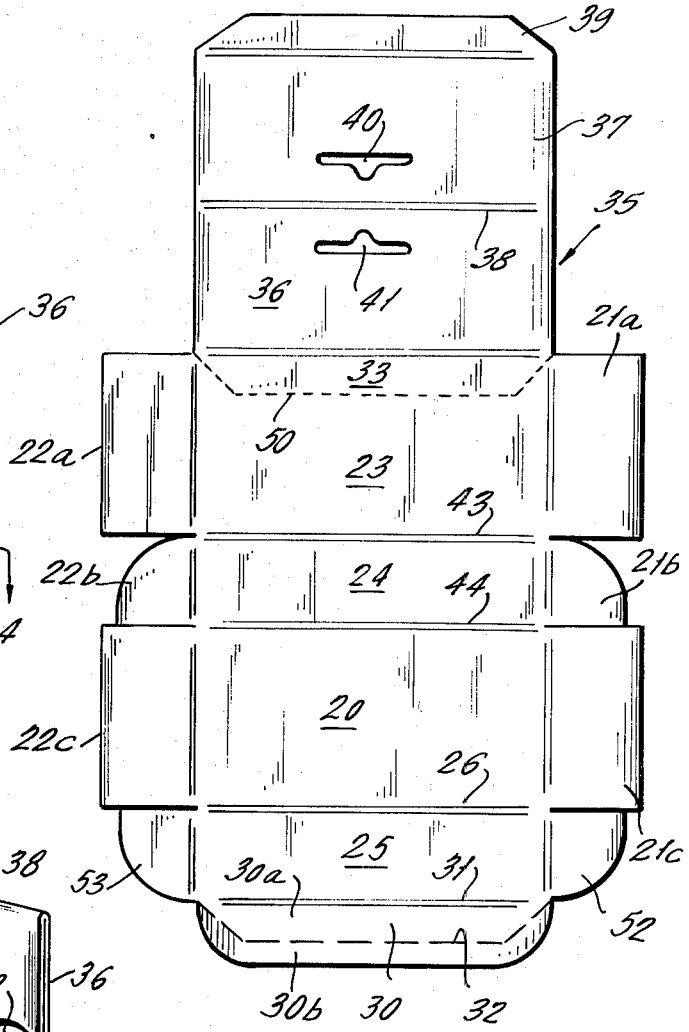
FIG. 2 is a plan view of the blank from which the carton of FIG. 1 is made.
Figure 4:
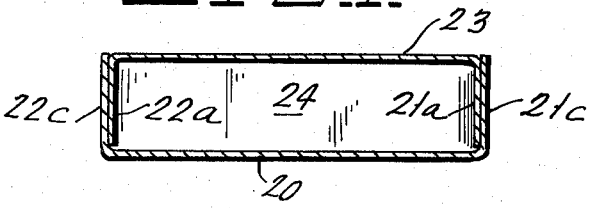
FIG. 4 is a cross sectional view taken on line 4, 4 of FIG. 1 looking in the direction of the arrows.
Figure 6:
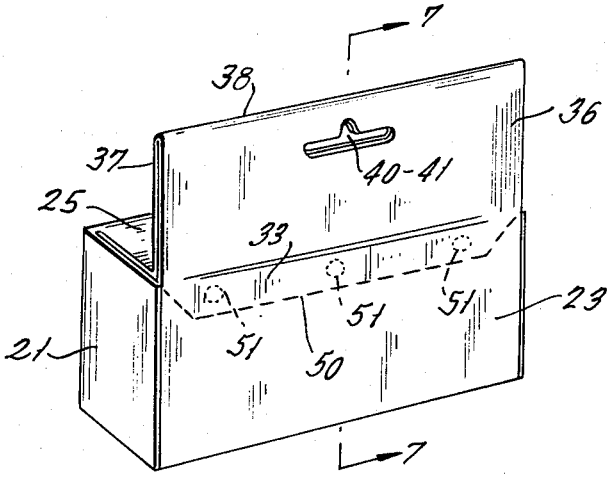
FIG. 6 is a view in perspective corresponding to that of FIG. 1 showing the rear of the carton of FIG. 1.
Figure 7:
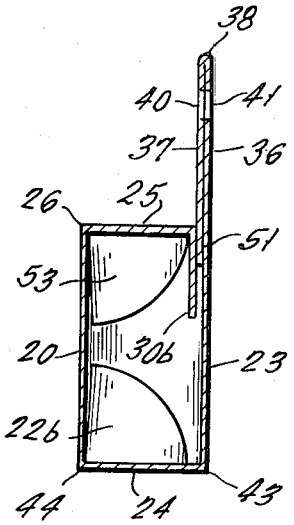
FIG. 7 is a cross sectional view taken on lines 7, 7 of FIG. 6 looking in the direction of the arrows.

Referring first to FIGS. 1 and 6, the novel carton or folding box of the present invention comprises a front wall 20, end walls 21 and 22, a rear wall 23, a bottom wall 24, (FIG. 4) and a top wall or cover 25 hingedly connected to the front wall 20 along the fold line 26. The top wall 25 is provided with a tuck-in flap 30 connected to the top wall 25 by the bend or fold line 31. The dashed line 32, on the flap 30 indicates two sections **30*a* and 30*b* of the tuck-in flap 30; it should be borne in mind that the tuck-in flap 30 is a single continuous piece, having, however, the sections 30*a* and 30*b*. The section 30*a* is later to be releasably attached or glued to the inner portion of section 33 of the wall 23 as hereinafter described, and then to operate in the manner shown by comparison of FIGS. 6, 8, and 9**.

The rear wall 23 has the double folded hanging panel 35 extending therefrom; this hanging panel consists of section 36 which is directly connected to the rear wall 23 and the foldover section 37 which is connected along the bend line 38 to the section 36 and the adhesive receiving section 39, which is connected to section 37. In forming the box the section 37 is folded on the fold line 38 into adhesive contact with the section 35 thereby forming a reinforced hanging extension from the rear wall 23. The openings 40 in panel 37 and 41 in panel 36 are aligned as shown in FIGS. 1 and 6 to provide a reinforced hanging opening to hang on a peg board or other support. As will be noted the rear wall 23 is hingedly connected along the bend line of 43 to the bottom wall 24 which in turn is connected along the bend line 44 to the front wall 20.

Figure 3:
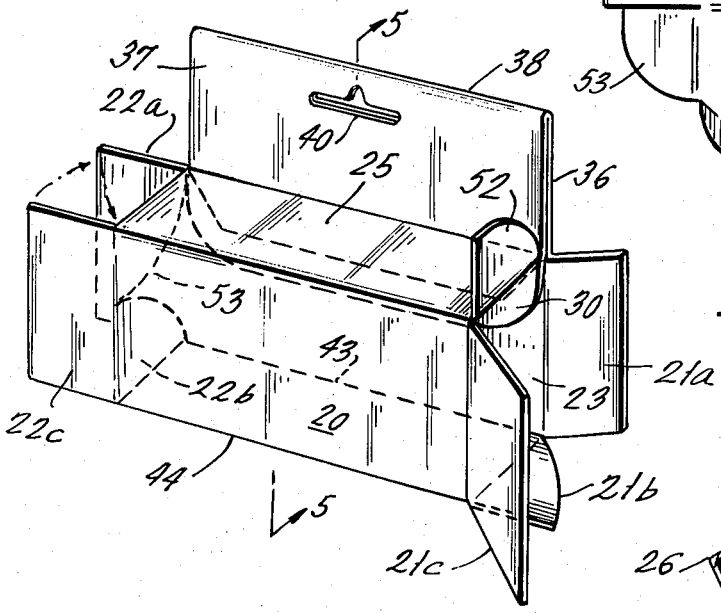
FIG. 3 is a schematic view in perspective showing the carton as erected by the manufacturer who is to insert his product into the carton prior to sealing up the ends of the carton.
Figure 5:
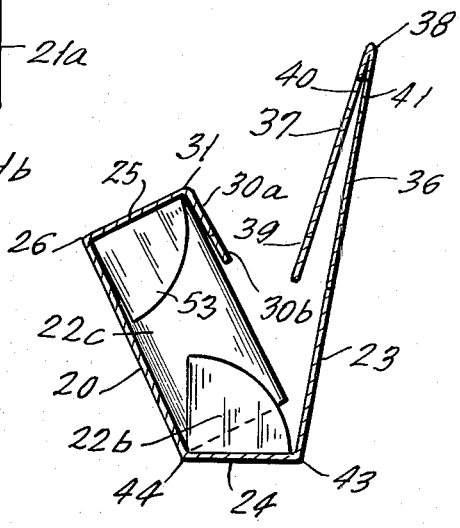
FIG. 5 is a cross sectional view taken on line 5, 5 of FIG. 3 looking in the direction of the arrows, and showing the method of completing the initial tubular carton construction.

These elements are folded up and a plurality of adhesive dots are applied in the area **30*a* of the tuck-in flap 30 to adhesively engage the section 39 of the hanging panel 35, 37. The box is thus formed into a tubular form as shown in FIG. 3 and, with the flaps 21*a*, 21*b*, 21*c* and 22*a*, 22*b*, 22*c*** extending outwardly of the box, may be shipped in a flat condition to the manufacturer of the product which is to be used to fill the box.

The manufacturer then closes one set of flaps, for instance the flaps **22*a*, 22*b*, 22*c*, securing them adhesively to form the wall 22 and then fills the carton or folding box from the other end, thereafter closing the flaps 21*a*, 21*b*, 21*c* upon each other adhesively in order to secure the contents in place. The box is now in the form shown in FIGS. 1 and 6** with the contents completely sealed and therefore pilfer proof—except, of course, for any deliberate attempt to destroy the box itself.

The structure may now be supported for display by the aligned openings 40, 41, being mounted on a peg board or other appropriate support and the reinforced panel 35–37 providing appropriate display or instructional material.

Figure 8:
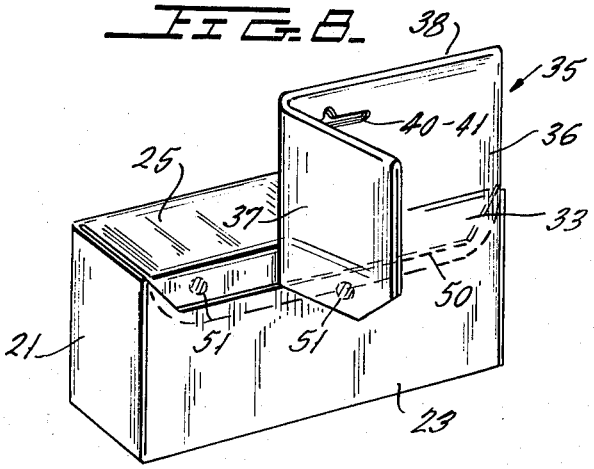
FIG. 8 is a view in perspective showing how the fifth panel may be torn off and nevertheless permit the folding of the tuck-in flap in place to produce a structure shown in FIG. 9.
Figure 10:
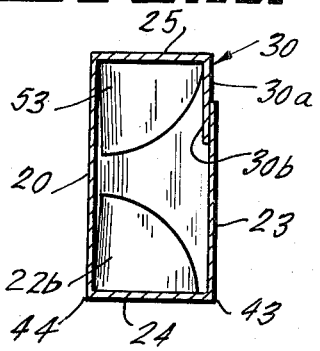
FIG. 10 is a cross-sectional taken on line 10, 10 of FIG. 9 looking in the direction of the arrows.
Figure 9:
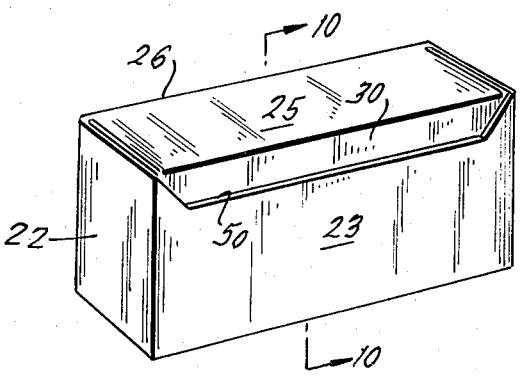
FIG. 9 is a view in perspective of the folding box or carton with the fifth panel torn off.
Figure 11:
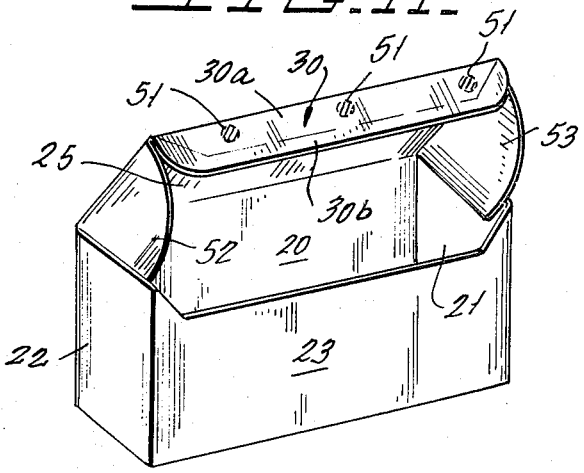
FIG. 11 is a view in perspective showing how the carton can be readily be sued, opened and closed, after the hanging panel of FIG. 8 is torn off.

When the customer removes the structure from the display or the article is otherwise submitted to the customer, the customer may now separate the display panel 35–37 from the box along the tear line 50 in the manner shown in FIG. 8. The glue dots which have connected the section 39 of panel 37 to the section 30*a* of the tuck-in flap permit this separation to take place. Section 30*b* of tuck-in panel 30 may now enter or be inserted adjacent the rear wall 23 as shown in FIGS. 9 and 10. Thus the cover 25, in connection with the flap extensions 52, 53, foldably secured to the lateral edges of the cover 25, forms a complete closure and seal for the carton so that the carton may open as shown in FIG. 11 and closed as shown in FIG. 9, even though the glue flap has been removed.

One of the major problems as previously pointed out in the case of boxes which are displayed at the point of sale so that they may be removed by the consumer is that that pilfering of the contents occurs. The utilization of the present structure wherein the box in completely sealed makes it necessary that, in order to pilfer any of the contents of the box, some portion of the box must be torn and make it obvious that the contents have been pilfered. When, however, the box is purchased and it is desired to carry or store the box and its contents, the panel 35 may be removed while nevertheless a complete cover 25 and tuck-in flap 30 is provided as shown in FIGS. 9, 10, and 11 so that the contents are readily available to the user while at the same time it is also possible to protect them fully until the contents are used up.

In the foregoing, the present invention has been described solely in connection with the preferred illustrative embodiments thereof. Since many variations and modifications of the present invention will now be obvious to those skilled in the art, it is preferred that the scope of this invention be defined not by the specific disclosures herein contained but only by the appended claims.

It is claimed:

1. A folding carton having a front wall, a bottom wall, a back wall, a cover hingedly secured to said front wall;

said cover having a tuck-in flap extending from the end of the cover opposite the hinged securement of the cover to said front wall;

said tuck-in flap being adapted to lie in face to face relation with a portion of the interior of said back wall when said cover is closed; said portion of said interior of said back wall being opposite said hinged securement of said tuck-in flap and comprising that part of said back wall engaged by said tuck-in flap;

a panel extending from said back wall beyond said portion of said back wall engaged by said tuck-in flap;

a tear line in said back wall extending below said panel;

said tuck-in flap having a first section in surface to surface engagement with the portion of the back wall between the tear line and said panel;

said tuck-in flap also extending below said tear line and having a second section in surface to surface engagement with said back wall;

releasable securing means between said first mentioned section of said tuck-in flap and the portion of the back wall between said tear line and said panel;

said panel and the portion of the back wall between said tear line and said panel being removable;

said second section of said tuck-in flap being engageable with said back wall after removal of said panel and the portion of the back wall between the tear line and panel.

2. The folding carton of claim 1 wherein said panel extending from said back wall is connected to a second panel foldable into surface to surface relation with said first panel and forming a hanging and display panel for said folding carton.

3. The folding carton of claim 1 wherein said front and rear walls are provided with lateral flaps engageable with each other to seal the ends of said folding carton.

4. The folding carton of claim 3 wherein the releasable engagement of said tuck-in flap with a portion of the rear wall and the sealing of said lateral flaps provides a pilfer-proof carton.

5. The folding carton of claim 4 wherein said panel extending from said rear wall is a doubled reinforced panel with an opening therein for hanging the carton.

6. The folding carton of claim 5 wherein, prior to the engagement of said lateral flaps, the carton is a tubular collapsible carton which may be shipped flat.

* * * * *